US005098210A

United States Patent [19]

Fujisawa et al.

[11] Patent Number: 5,098,210

[45] Date of Patent: Mar. 24, 1992

[54] SHEET FEEDING APPARATUS FOR A PRINTING MACHINE FEATURING A RESILIENTLY SUPPORTED ARM AND PLANETARY GEAR

[75] Inventors: Tadao Fujisawa; Yoshihiro Hamamichi, both of Mishima; Yoshiaki Tanaka, Numazu; Kozo Hara, Nakaizu; Tsuyoshi Sanada, Susono; Masayoshi Koyanagi, Tagata, all of Japan

[73] Assignee: Tokyo Electric Company, Ltd., Tokyo, Japan

[21] Appl. No.: 343,365

[22] Filed: Apr. 26, 1989

[30] Foreign Application Priority Data

Apr. 28, 1988 [JP] Japan ..... 63-58349[U]
Nov. 29, 1988 [JP] Japan ..... 63-301664

[51] Int. Cl.[5] ..... B41J 13/10

[52] U.S. Cl. ..... 400/624; 400/629; 74/421 R; 74/384

[58] Field of Search ..... 400/307.2, 358, 552, 400/569, 577, 624, 625, 629, 649, 660, 660.1, 660.2, 692; 74/384, 421 R, 421 A, 665 B, 665 G, 665 GA, 810.1

[56] References Cited

U.S. PATENT DOCUMENTS

| | | | |
|---|---|---|---|
| 2,542,073 | 2/1951 | Aberle . | |
| 2,716,349 | 8/1955 | Nisenson | 74/421 A |
| 2,751,843 | 6/1956 | Faeber | 101/352 |
| 2,875,692 | 3/1959 | Koch | 101/352 |
| 3,753,483 | 8/1973 | Lindquist et al. | 400/649 |
| 3,943,786 | 3/1976 | Mills | 74/384 |
| 4,273,000 | 6/1981 | Schmid | 74/206 |
| 4,602,561 | 7/1986 | Nakajima | 101/93.28 |

FOREIGN PATENT DOCUMENTS

| | | | |
|---|---|---|---|
| 0123310 | 10/1984 | European Pat. Off. . | |
| 191951 | 3/1984 | Japan . | |
| 185672 | 10/1984 | Japan | 400/624 |
| 185673 | 10/1984 | Japan | 400/624 |
| 185675 | 10/1984 | Japan | 400/624 |
| 257267 | 12/1985 | Japan . | |
| 768589 | 2/1957 | United Kingdom . | |
| 801075 | 10/1958 | United Kingdom . | |

*Primary Examiner*—David A. Wiecking
*Attorney, Agent, or Firm*—Oblon, Spivak, McClelland, Maier & Neustadt

[57] ABSTRACT

The present invention, whose auto sheet feeder is demountably mounted on a printing machine, which includes a sequential arrangement of a reversible motor, a transmission mechanism, and a rotatable platen, is provided with an input gear, an arm whose one end is supported by the input gear for rotation around its axis of rotation and is urged to move toward a gear of the transmission mechanism, and as planetary gear rotatably provided at the end of the arm to be constantly in mesh with the input gear and opposite to the periphery of the gear of the transmission mechanism.

3 Claims, 8 Drawing Sheets

SHEET FEEDING APPARATUS FOR A PRINTING MACHINE FEATURING A RESILIENTLY SUPPORTED ARM AND PLANETARY GEAR

FIELD OF THE INVENTION AND RELATED ART STATEMENT

The present invention relates to an apparatus for sheet feeding for use in a printing machine in which an auto sheet feeder is used by being demountably mounted on the printing machine.

A prior art example is shown in FIG. 10. Referring to the figure, reference numeral 1 denotes a printing machine which is shown therein only partly. A reversible motor 3 is provided attached to a side plate 2*a* on one side of a frame 2 of the printing machine 1. There are provided a platen 4 and a driving shaft 5 rotatably supported by both side plates 2*a* of the frame 2 and there are also provided support shafts 6 and 7 stretched between the two side plates 2. A tractor 8 is slidably put on the driving shaft 5 and the support shaft 7, so as to be fixed at a desired position. On the periphery of the platen 4 is pressed a pinch roller 9. For transmitting the rotation of the motor 3 to the tractor 8 and the platen 4, there is provided a transmission mechanism 10 made up of a gear 11 directly coupled with the motor 3, a gear 13 in mesh with the gear 11 for rotating integrally with a gear 12, a gear 14 in mesh with the gear 12, a gear 15 fixed to an end portion of the driving shaft 5 and in mesh with the gear 14, and a gear 16 fixed to an end of the shaft portion of the platen 4 and in mesh with the gear 12.

Now, the structure of an auto sheet feeder 17 adapted to be selectively mounted on the printing machine 1 will be described. Reference numeral 18 denotes a body having two side plates 19 facing to each other. Between both the side plates 19, of which the one in the foreground is not shown, a sheet holder 21 for holding a pile of a plurality of sheets 20 is removably set. On both the side plates 19, there are provided arms 22, each thereof being supported by a support shaft 24 for rotation around it and urged by a spring 23 in the direction away from the sheet holder 21. There is a sheet feed roller 25 rotatably supported by the rotatable free ends of the arms 22, and to one end of the sheet feed roller 25 is fixed a pulley 26. A belt 28 is passed around the pulley 26 and a pulley 27, which is rotatably supported by one of the side plates 19. There are a sheet discharge roller 29 and a pinch roller 30, which is pressed against the discharge roller 29, rotatably supported by the side plates 19. Further, both the side plates 19 bear a rotatable shaft 33 integrally rotating with cams 32 in contact with rollers 31 attached to outer sides of the arms 22. Gears 34, 35, 36, 37, and 38 for successively transmitting the rotation of the gear 16 to the rotatable shafts 33 and a gear 39 in mesh with the gear 35 are provided at the position closer to one of the side plates 19. The gear 34 is fixed to one end of the pulley 27, the gear 39 is fixed to one end of the discharge roller 29, and the gear 38 is fixed to one end of the rotatable shaft 33. The gear 38 and the rotatable shaft 33 are coupled through a one way clutch 40. Both the side plates 19 are fixedly provided with fitting pieces 41 and 42 to be detachably supported on the support shafts 6, 7, which are stretched between both the side plates 2*a* of the frame 2 of the printing machine 1 and a sheet guide plate 43.

Operation will be described now. When the auto sheet feeder 17 is not in use, the rotation of the motor is transmitted through the transmission mechanism 10 to the platen 4 and the sheet is fed by means of the platen 4 and pinch roller 9 rotating in a counterclockwise direction. Or, the rotation of the motor 3 is also transmitted to the tractor 8 through the transmission mechanism 10 and the driving shaft 5 and a sheet is supplied by the tractor 8 to the portion below the platen 4.

When the auto sheet feeder 17 is in use, its fitting pieces 41, 42 are fitted to the support shafts 6 and 7. The motor 3 is rotated in a clockwise direction and the gear 16 on the shaft center of the platen 4 is thereby rotated clockwise. Then, on the one hand, the rotation of the gear 16 is transmitted to the sheet feed roller 25 through the gear 34, pulley 27, belt 29, and the pulley 26, and on the other, it is transmitted to the cam 32 through the gears 35, 36, 37, and 38, one way clutch 40, and the rotatable shaft 33. Thus, the sheet feed roller 25 is rotated counterclockwise and the cam 32 is also rotated counterclockwise, so that the roller 31 is pressed down together with the arm 22, thereby causing the sheet feed roller 25 to be brought into contact with a sheet 20. Thus, the sheet 20 is delivered. When the cam 32 has made a full rotation, the arm 22 is allowed to return to its original position by means of the spring force of the spring 23. Hence, the sheet feed roller 25 separates from the sheet 20. In the mean time, the front end of the sheet 20 reaches the contact position between the platen 4 and the pinch roller 9, whereupon a sheet detector, not shown, detects the sheet 20 and outputs a detected signal which reverses the motor 3 to rotate counterclockwise. Thereby, the platen 4 is rotated counterclockwise and feeds the sheet 20 into the front of a printing head (not shown). Although the gear 34 rotates clockwise at this time, the one way clutch 40 does not transmit the rotation in this direction to the cam 32, so that the sheet feed roller 25 rotates clockwise held separated from the sheet 20 and does not make the sheet delivery operating. Meanwhile, the sheet discharge roller 29 receiving the rotation of the gear 34 through the gears 35 and 39 discharges the sheet 20 fed from the platen 4.

In the auto loading process, the sheet delivery operation is caused by the rotation of the platen 4 in one direction, and the feeding of the sheet into the front of the printing head is caused by the rotation in the other direction. Therefore, it is required that the relative position of the gear 16 and the auto sheet feeder 17 is set accurately.

If there is a dimensional error in fitting the auto sheet feeder 17 to the printing machine 1, it follows that the gear 16 comes to be poorly meshed with the gear 34, transmission of rotation becomes unstable, wear of the teeth is accelerated, and noises at the portions of engagement become high. Especially, there has been an increasing demand for the lowering of such a noise, and the opening in the top surface of the printing machine 1 has become smaller. Hence, there is even such a demand to install an auto sheet feeder 17 not on a frame 2 having high rigidity but on a cover (not shown) of a printing machine 1, in which case since rigidity of the cover is low, there is produced a problem that the relative position of the printing machine 1 and the auto sheet feeder 17 becomes all the more inaccurate.

It is also demanded to provide an arrangement enabling an auto sheet feeder 17 to be mounted on a printing machine 1 simply and with accurate coupling ensured.

OBJECTS AND SUMMARY OF THE INVENTION

A first object of the present invention is to ensure accurate mesh engagement between a gear on the side of a printing machine and a planetary gear on the side of an auto sheet feeder even if there is some fluctuation in positioning to fit the auto sheet feeder to the printing machine.

A second object of the present invention is to ensure accurate mesh engagement between a gear on the side of a printing machine and a planetary gear on the side of an printing machine and a planetary gear on the side of an auto sheet feeder by using a simple arrangement.

A third object of the present invention is to prevent wear of the portions of gears put into mesh engagement.

A fourth object of the present invention is to prevent occurence of noises from the portions of gears coming into mesh engagement.

A fifth object of the present invention is to simplify the operation for fitting an auto sheet feeder to a printing machine.

According to one aspect of the present invention, there is provided an apparatus for sheet feeding for use in a printing machine which comprises an auto sheet feeder, whose main body is adapted to be demountably mounted on a printing machine, the printing machine having a sequential connection of a reversible motor, a transmission mechanism, and a rotatable platen provided on its frame, having, arranged on the main body, a sheet holder holding at least a pile of plural sheets, a sheet feed roller to be put into contact with the topmost layer of the sheets in the sheet holder, and an input gear coupled with the sheet feed roller, an arm whose one end is supported by the input gear for rotation around its axis of rotation and urged to move toward a gear of the transmission mechanism, and a planetary gear attached to the arm for rotation, constantly held in mesh with the input gear, and disposed to oppose the periphery of the gear of the transmission mechanism.

According to another aspect of the present invention, the apparatus comprises a pair of arms urged to move inwardly toward each other with a straight line connecting the centers of the input gear and the gear in the transmission mechanism centered, and a pair of planetary gears each thereof being attached to each of the arms for rotation, constantly held in mesh with the input gear, and disposed to oppose the periphery of the gear of the transmission mechanism.

According to a further aspect of the apparatus of the present invention, it comprises coupling means made up of a mesh engagement mechanism for keeping a planetary gear constantly in mesh with the input gear and disengagement mechanism, when the auto sheet feeder is detached from the printing machine, for disengaging the mesh engagement mechanism.

Since, the input gear, arm, and planetary gear are supported on the same body of the auto sheet feeder, there is produced only small fluctuations in relative position. Thus, the input gear and the planetary gear are maintained in a good mesh engagement state and, when the auto sheet feeder is mounted on the printing machine, the planetary gear can be resiliently brought into mesh engagement with the transmission mechanism on the side of the printing machine, whereby the gear on the side of the printing machine and the planetary gear can be maintained in good mesh engagement.

Further, by the provision of planetary gears on the ends of a pair of arms arranged with a straight line connecting the centers of the input gear of the auto sheet feeder and the gear in the transmission mechanism centered, the pair of planetary gears are resiliently brought into mesh engagement with the gear in the transmission mechanism on the side of the printing machine at both sides thereof, whereby the gear on the side of the printing machine and the planetary gear can be maintained in good mesh engagement.

Further, by the provision of the disengagement mechanism for disengaging the mesh engagement mechanism when the auto sheet feeder is removed from the printing machine, the operation for setting the auto sheet feeder can be performed without the need for paying special attention to the meshing of the planetary gear with the gear in the transmission mechanism and the gears can be put into mesh engagement with each other after the setting, and thus, mounting and demounting of the auto sheet feeder can be performed simply.

BRIEF DESCRIPTION OF THE DRAWINGS

FIG. 1 to FIG. 5 are for showing a first embodiment of the present invention; wherein FIG. 1 is a side view partly in section;

FIG. 2 is a perspective view of entire structure;

FIG. 3 is an enlarged side view showing a support arrangement of arms and planetary gears;

FIG. 4 is a side view showing a power transmitting state of planetary gears at the time when a sheet is delivered; and FIG. 5 is a side view showing a power transmitting state of planetary gears at the time when a sheet is fed.

FIG. 6 to FIG. 9 are for showing a second embodiment of the present invention; wherein FIG. 6 is a side view partly in section;

FIG. 7 is a side view showing a state of planetary gears of coupling means in mesh engagement with a driving gear;

FIG. 8 is a side view showing a state of the planetary gears of coupling means disengaged from the driving gear; and FIG. 9 is a perspective view of entire structure.

DETAILED DESCRIPTIONS OF THE PREFERRED EMBODIMENTS

Figure 1:
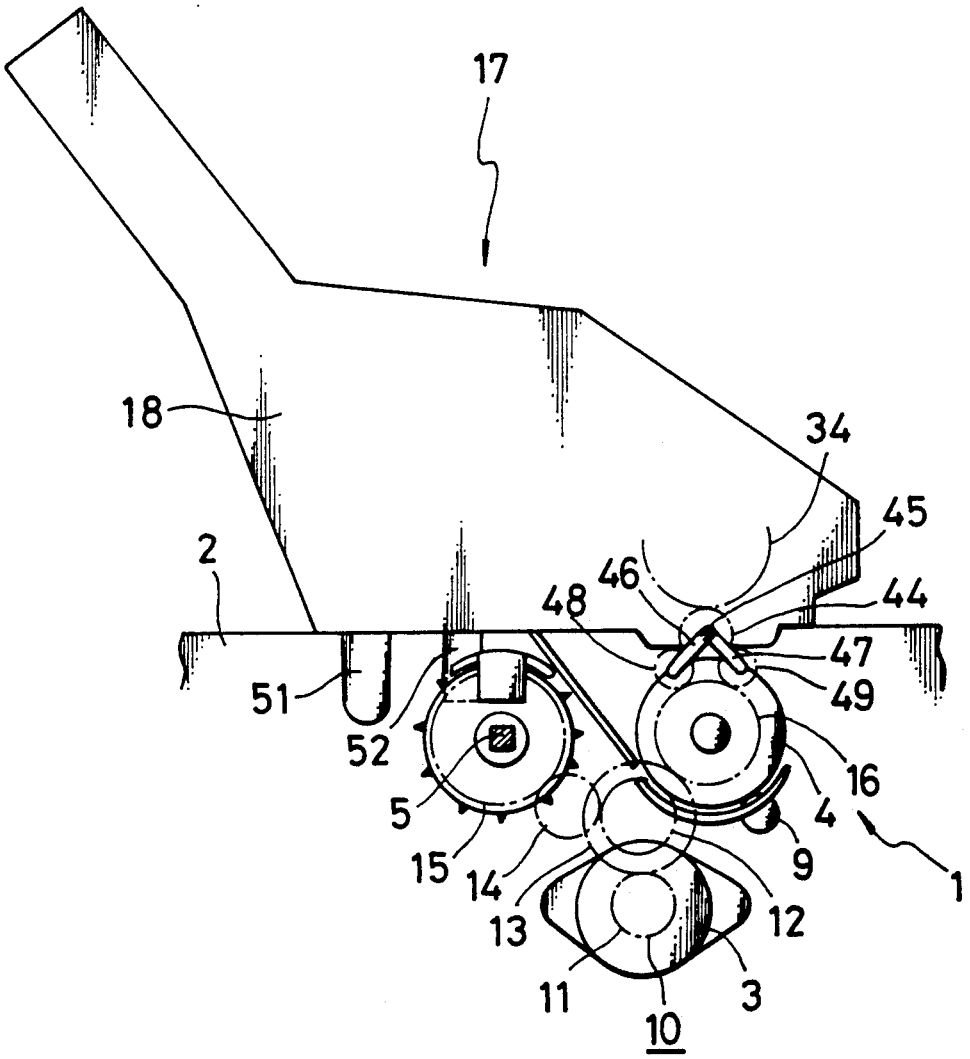
Figure 2:
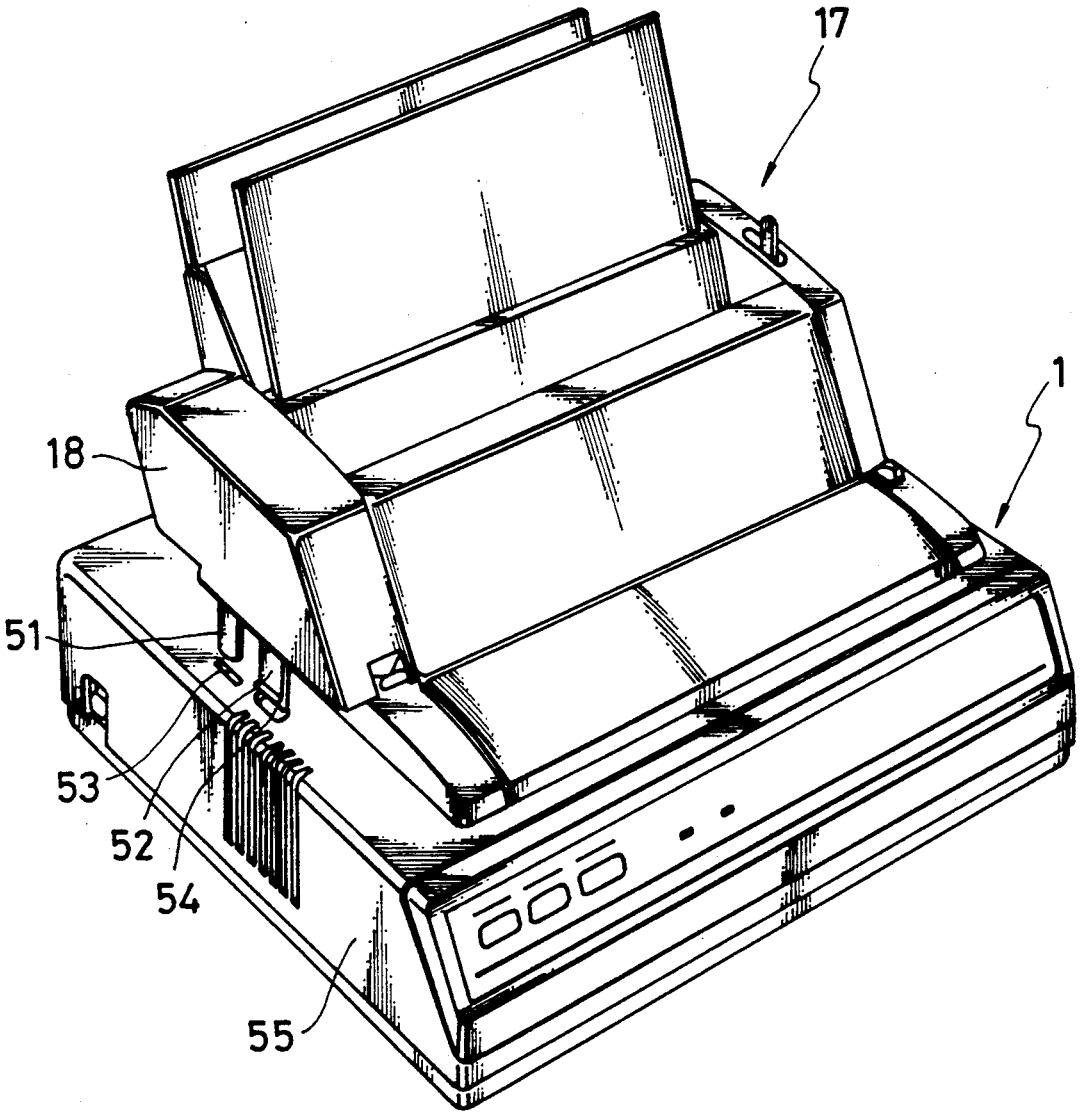
Figure 3:
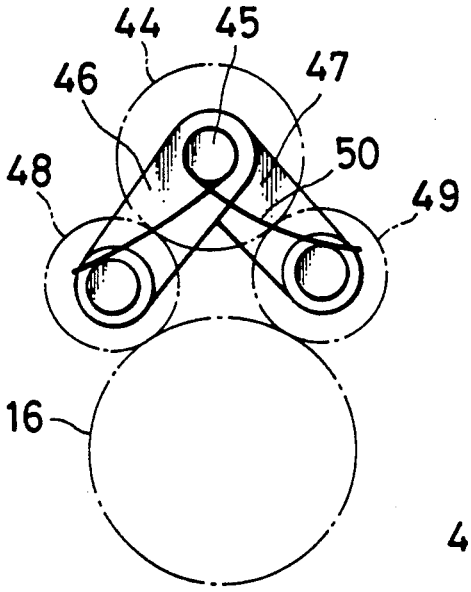
Figure 4:
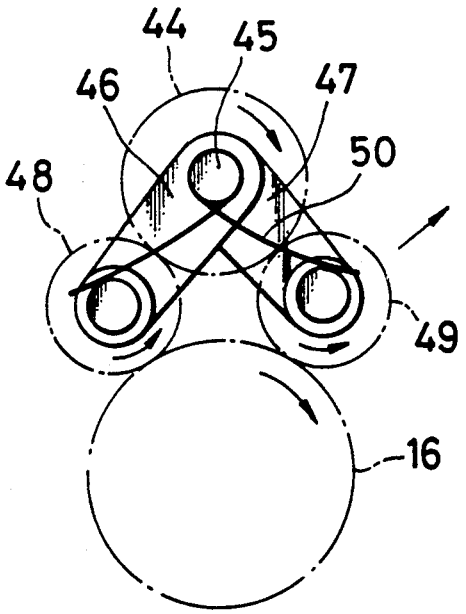
Figure 5:
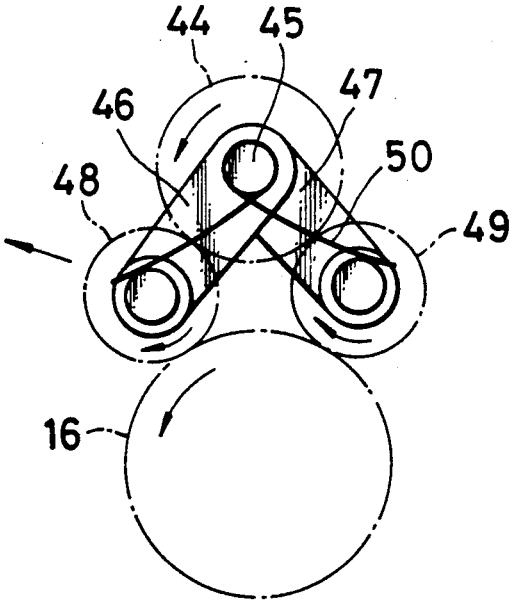
Figure 10:
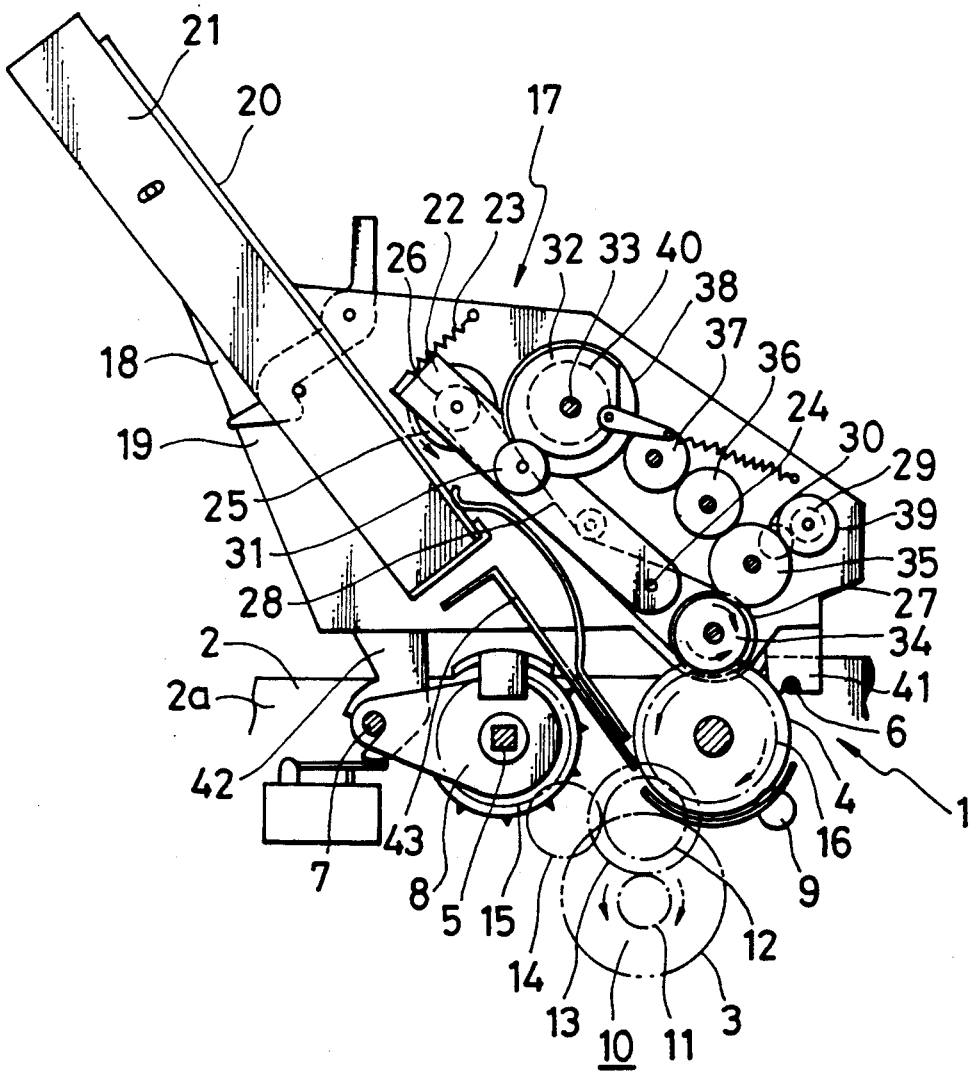
FIG. 10 (PRIOR ART)
FIG. 10 is a side view showing a prior art example.

A first embodiment of the present invention will now be described with reference to FIG. 1 to FIG. 5. Parts corresponding to those described in FIG. 10 are denoted by the same reference numerals and description thereof will be omitted. Being held by the body 18 of an auto sheet feeder 17, there is provided a shaft 45 for rotatably bearing an input gear 44 constantly in mesh with a gear 34. This shaft 45 supports a pair of arms 46 and 47 for rotation and these arms 46, 47 support planetary gears 48 and 49 for rotation constantly in mesh with the input gear 44. As shown in FIG. 3 to FIG. 5, these arms 46, 47 are urged inwardly or toward each other by means of a torsion spring 50 supported on a shaft 45 with its pair of legs put in abutment with the shaft portions of the planetary gears 48, 49, but their inward movement is restricted by a stopper (not shown) so that the legs, as they come closer to a gear 16 on the side of the printing machine 1, are separated wider from the straight line connecting the center of the input gear 44 and the center of the gear 16. Such a stopper is provided on the side of the body 18.

On each side of the body 18, there are provided a rib 51 and an elastic and bendable engagement piece 52. Meanwhile, as shown in FIG. 2, a slit 53 for inserting the rib 51 and an opening 54 for inserting the engagement piece 52 therein are made in the top surface, at each side, of the housing 55 of the printing machine 1. Within each opening 54, there is formed an engagement portion (not shown) on the frame 2 with which the engagement piece 54 comes into resilient engagement.

With the described arrangement, since the planetary gears 48, 49, being supported by the arms 46, 47 rotatably supported by the shaft 45 bearing the input gear 44, are constantly in mesh with the input gear 44, they exhibit only small fluctuations in relative position with the input gear 44, and hence, they are in mesh with the input gear 44 within a range of a suitable backlash.

By inserting the rib 51 into the slit 53 so that the auto sheet feeder 17 is aligned with the printing machine 1 and thereby causing the engagement piece 54 resiliently engaged with the engagement portion of the frame 2, the auto sheet feeder 17 can be mounted on the printing machine 1. Since, at this time, the planetary gears 48, 49 come into abutment with the gear 16 on the side of the printing machine 1, the pair of arms 46, 47 rotationally move outward or in the opposite directions to that in which they are urged. Thus, the pair of planetary gears 48, 49 resiliently come into mesh engagement with the gear 16 at its both sides by the force acting on the arms 46, 47, whereby a good meshing condition is obtained between the gear 16, planetary gears 48, 49, and the input gear 44.

The sheet feed operation is the same as described above. That is, as shown in FIG. 4, the gear 16 of the printing machine 1 is rotated clockwise. When a sheet 20 supplied by the sheet feed roller 25 and transported by the platen 4 is discharged by the discharge roller 29, the gear 16 is rotated counterclockwise as shown in FIG. 5. While the rotation of the gear 16 is transmitted to the input gear 44 of the auto sheet feeder 17 in any way, since the planetary gears 48, 49 are resiliently put in mesh engagement with the gear 16, even if there occurs an error in the fitted position between the printing machine 1 and auto sheet feeder 17, a positive power transmission between the transmission mechanism 10 of the printing machine 1 and the auto sheet feeder 17 is ensured.

Since the present embodiment is arranged as described above, the input gear, arms, and the planetary gears are supported on the same body of the auto sheet feeder, there occurs no significant fluctuations in the relative position so that the input gear and the planetary gears can be maintained in a good meshing condition. When mounting the auto sheet feeder on the printing machine, it is enabled to have the pair of the planetary gears resiliently put into mesh engagement with the gear, at its both sides, of the transmission mechanism on the side of the printing machine, and therefore, even if there are some fluctuations in the dimensions for installing the auto sheet feeder on the printing machine, it is enabled to maintain the gear on the side of the printing machine and the planetary gears on the auto sheet feeder in good meshing condition. Thus, such effects are obtained that wear of the gear on the side of the printing machine and the planetary gears and input gear on the side of the auto sheet feeder can be prevented from being produced and noises are prevented from being generated from the portions coming into mesh engagement.

Figure 6:
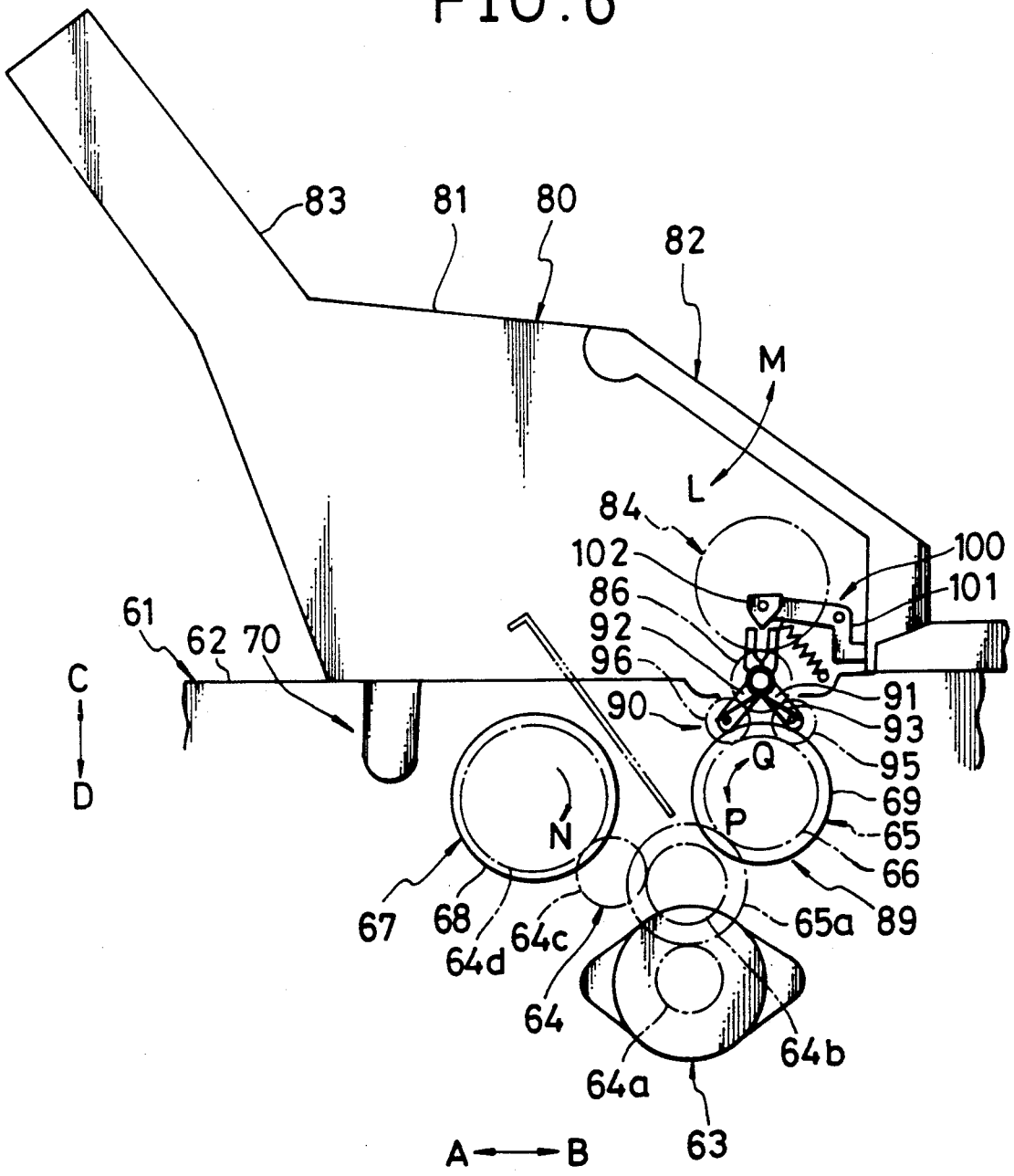

Below will now be described a second embodiment of the present invention with reference to FIG. 6 to FIG. 9. An auto sheet feeder 80 is adapted to be demountably mounted on a printing machine 61 through a coupling means 89 for bringing an input gear 86 into mesh engagement with a driving gear 66 of the printing machine 61 as shown in FIG. 6. Since the auto sheet feeder 80 is of the same structure as that in the conventional ones for its positioning means 70 and so on, description of these will be omitted. However, a clutch shift mechanism, described later, is different from that in the prior art sheet feeding apparatus and, the coupling means 89 is the one characteristic of the present invention, and therefore, the clutch shift mechanism and the coupling means 89 will be described below in detail.

The auto sheet feeder 80 is provided with a clutch shift mechanism (not shown) for shifting a clutch provided between the feed mechanism and the gear mechanism 84 by changing the rotation of the input gear 86 in two, normal and reverse, directions. More particularly, when the input gear 86 rotates in the normal direction, i.e., in agreement with the arrowhead P shown in the gear 66, the clutch is put into engagement, whereby the power of the printing machine is transmitted through the gear mechanism 84 to the feed mechanism so that the sheet is fed automatically. When the input gear 86 rotates in the reverse direction, i.e., in agreement with the arrowhead Q shown in the gear 66, the clutch is disengaged and the feed mechanism is stopped.

The coupling means 89 is arranged to be provided on the side of the auto sheet feeder 80 taking it into consideration that the auto sheet feeder 80 is used at the option, and it is made up of a mesh engagement mechanism 90 for bringing the driving gear 66 into engagement with the input gear 86 and a disengagement mechanism 100 for releasing the engagement.

Figure 7:
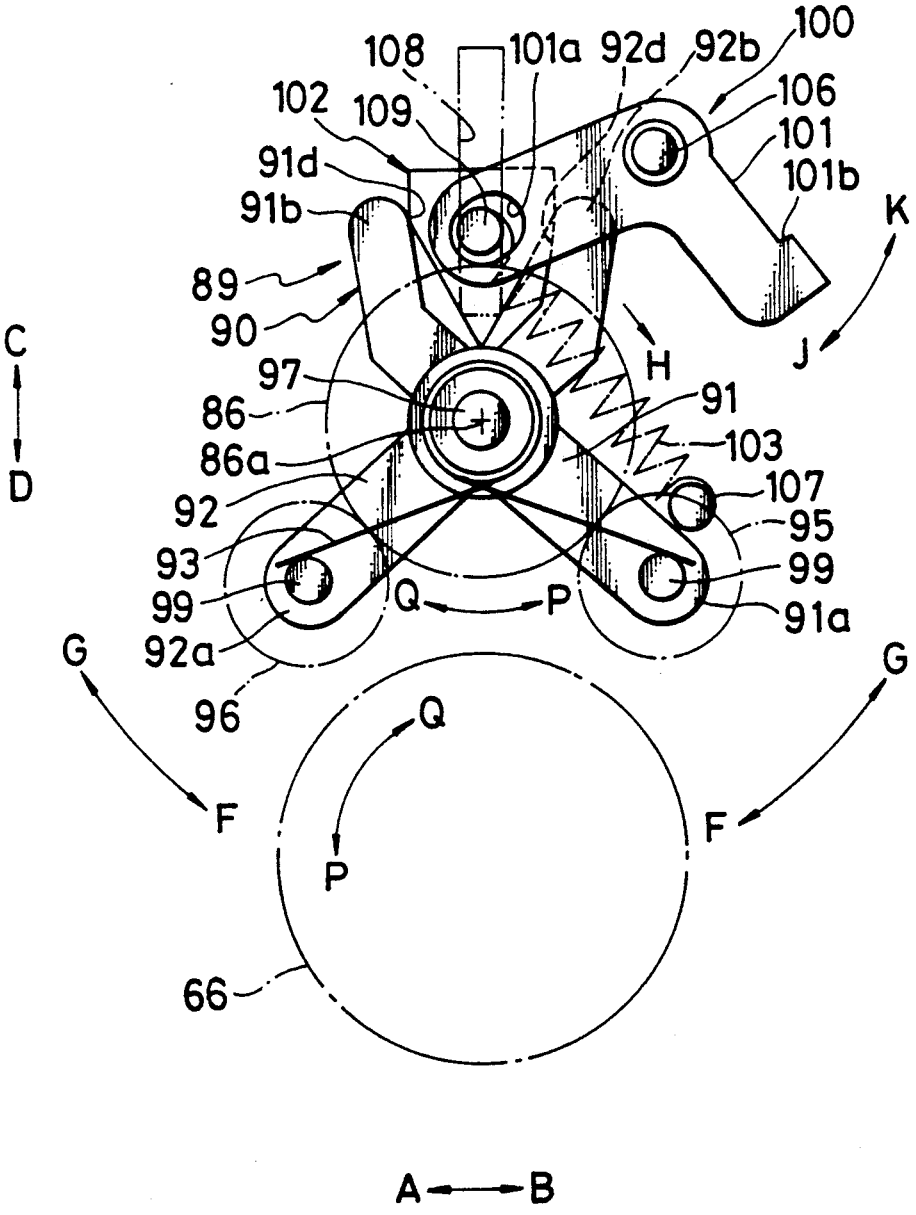

The mesh engagement mechanism 90 is the one that absorbs the relative displacement of the auto sheet feeder 80 and the printing machine 61 to thereby ensure accurate mesh engagement of the input gear 86 with the driving gear 66, and according to the present embodiment, the same is made up, as shown in FIG. 7, of a pair of first and second arms 91 and 92 attached to the input gear 86 for rotation around the axis 86*a* of the input gear 86, planetary gears 95, 96 rotatably provided at the ends of a pair of first and second arms 91 and 92 and being in mesh with the input gear 86, and a torsion spring 93 for urging the first and second arms 91, 92, in the state of the auto sheet feeder 80 mounted on the printing machine 61, in one direction to thereby bring the planetary gears 95, 96 into mesh engagement with the driving gear 66 on the side of the printing machine 61.

On the inside of the back ends 91*b* and 92*b* of the first and second arms 91, 92, there are formed sliding surfaces 91*d* and 92*d*.

The torsion spring 93 is disposed so that the first and second arms 91, 92 are urged thereby in one direction (in the direction indicated by the arrowheads F in the present embodiment) through the pins 99, that is, the spring is disposed so that the driving gear 66 and the input gear 86 are put into mesh engagement.

The disengagement mechanism 100 is for releasing the mesh engagement mechanism 90 and the same is arranged, in the state of the auto sheet feeder 80 disengaged from the printing machine 61, to pull back the first and second arms 91, 92 against the spring force of the torsion spring 93. In the present embodiment, the disengagement mechanism 100 is arranged to be automatically operated when the condition to start printing is established, that is, when the cover 82 shown in FIG. 6 is shut. More particularly, the disengagement mechanism 100 is made up of a disengagement arm 101, a releasing groove 108, etc., and the disengagement arm 101 is arranged to be rotatable around a pin 106 in the directions indicated by the arrowheads J and K. The disengagement arm 101 is provided with an elongated hole 101*a* made therein at its end to the left in the figure and an input portion 101*b* at its end to the right in the figure.

In the elongated hole 101*a*, there is slidably fitted a pin 109 embedded in a wedge member 102. The guide groove 108 is made in the body 81 of the sheet feeder stretched in the direction toward the axis 86*a* of the input gear 86. In the guide groove 108, there is disposed the wedge member 102 constituting the disengagement arm 101 for movement in the directions of the arrowheads C and D by means of the pin 109. Between the pin 109 and a pin 107 provided below the pin 109 in the figure, a spring 103 is stretched so that the wedge member 102 is urged in the direction of the arrow H by means of the spring 103.

Operation will now be described below.

Figure 8:
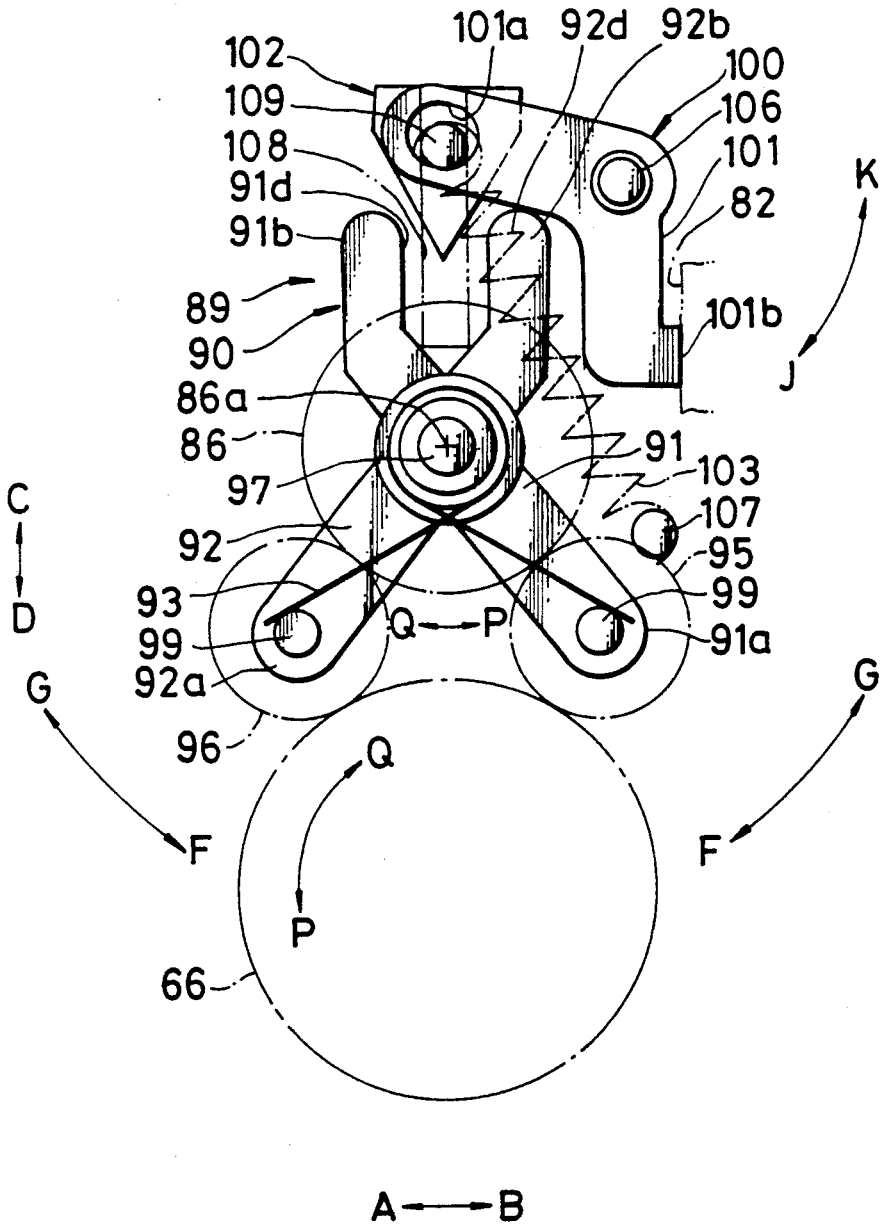
Figure 9:
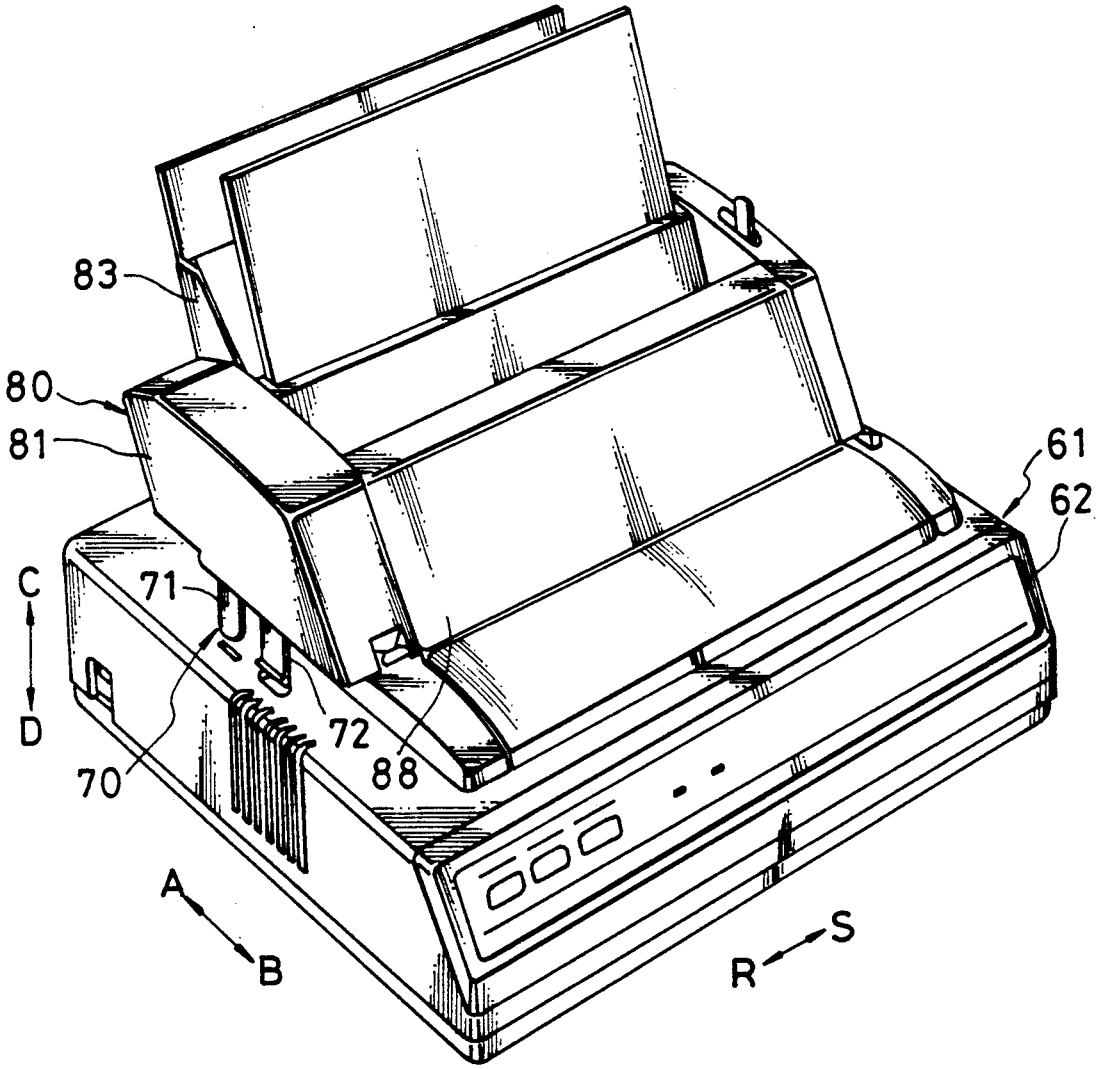

In mounting the auto sheet feeder 80 on the printing machine 61 as shown in FIG. 9, first, the cover 82 shown in FIG. 6 is rotated in the direction of the arrowhead M to be opened up. Then, the disengagement mechanism 100 is automatically operated so that, as shown in FIG. 8, its disengagement arm 101 is released from the restriction in its movement in the direction of the arrowhead K by the cover 82, and hence, the arm 101 is caused to rotate in the direction of the arrowhead K by the resilient force of the spring 103. Then, the wedge member 102 is moved in the direction of the arrowhead D with its pin 109 moving along the guide groove 108 pushed by the disengagement arm 101.

Thus, the wedge member 102 comes in abutment with the sliding surfaces 91*d*, 92*d* of the first and second arms 91, 92 and further moves through the sliding surfaces 91*d*, 92*d* a predetermined distance thereby causing the sliding surfaces 91*d*, 92*d* to be pushed apart. As a result, the first and second arms 91, 92 together with the planetary gears 95, 96 are rotated in the directions of the arrowheads G against the resilient force of the torsion spring 93, whereby they are pulled back to the positions indicated by the one-dot chain lines in FIG. 7.

Thereupon, the auto sheet feeder 80 is mounted on the printing machine 61 using the positioning means 70 shown in FIG. 9. Since, at this time, the first and second arms 91, 92 are pulled back to the positions indicated by the one-dot chain lines in FIG. 7, the auto sheet feeder 80 can be mounted on the printing machine 61 smoothly and easily, without causing such as collision of the planetary gears 95, 96 with the driving gear 66.

In the mounting operation of the auto sheet feeder 80 on the printing machine 61, even if the auto sheet feeder 80 is relatively displaced from the printing machine 61 due to machining error and fitting error of positioning means 70 and the like and the input gear 86 is displaced from the driving gear 66 three-dimensionally (in X-, Y-, and Z-axes), such displacement is absorbed by the coupling means 89 and it is enabled to bring the input gear 86 into accurate mesh engagement with the driving gear 66 by means of the coupling means 89.

More particularly, in bringing the input gear 86 into mesh with the driving gear 66, the condition to start the printing is first established. For achieving this, the opened cover 82 is rotated in the direction of the arrowhead L in FIG. 6 to be shut down. Then, the cover 82 pushes the input portion 101*b* of the disengagement arm 101 in the direction indicated by the arrowhead A in FIG. 7. The disengagement arm 101 rotates in the direction of the arrowhead J against the spring force of the spring 103. Then, the wedge member 102, being pulled up by the arm 101, moves along the guide groove 108 in the direction of the arrowhead C in FIG. 8 to separate from the first and second arms 91, 92 upward.

As a result, the first and second arms 91, 92, being urged by the torsion spring 93 in the directions of the arrowheads F, are rotated in the directions of the arrowheads F until the planetary gears 95, 96 come closer to each other thereby to be put into normal engagement with the driving gear 66.

Thus, there occurs no fluctuations in pitches in mesh engagement between the input gear 86 and the driving gear 66, and even if there is displacement in the Y-axis (in the directions of the arrowheads A and B) or in the Z-axis (in the direction of the arrowheads C and D) of the input gear 86 relative to the driving gear 66, the input gear 86 comes into normal mesh engagement with the driving gear 66 through the planetary gears 95, 96.

At this time, since the first and second arms 91, 92 rotate in the directions of the arrowheads F with the axis 86*a* of the input gear 86 centered, the distances between the planetary gears 95, 96 and the input gear 86 are maintained constant, and hence, the planetary gears 95, 96 neither separate from the input gear 86 nor exert too heavy pressure upon the input gear 86.

With the input gear 86 thus put into mesh with the driving gear 66 through the planetary gears 95, 96 in the described way, the driving motor 63 shown in FIG. 6 is operated. Then, the sheet feed member 68 is rotated in the direction of the arrow N through the gear mechanism 64 and the driving gear 66 is driven in the direction of the arrowhead P. Then, the input gear 86 is rotated through the planetary gear 95 attached to the first arm 91 in the normal direction indicated by the arrowhead P, whereby the feed mechanism of the auto sheet feeder 80 is driven through the gear mechanism 84 and the clutch so that the sheet is automatically delivered from the cassette 83 to the printing machine 61.

At this time, since the planetary gear 95 is urged so as to be squeezed in-between the driving gear 66 and the input gear 86, it never separates from the driving gear 66.

The sheet thus fed into the printing machine 61 is engaged with the sheet feed member 68 of the printing machine 61 and fed toward the printing machine being guided by the sheet feed member 68.

When the engagement of the sheet with the sheet feed member 68 is detected, the driving motor 63 is reversed so that the driving gear 66 is rotated in the direction indicated by the arrowhead Q (meanwhile, the sheet feed member 68 is kept on rotating in the direction of the arrowhead N even if the driving motor 63 is reversed by means of one way rotational mechanism.)

Then, the input gear 86 is reversely rotated in the direction indicated by the arrowhead Q through the planetary gear 96 attached to the second arm 92, and thereby, the clutch between the sheet feed mechanism of the auto sheet feeder 80 and the gear mechanism 84 disengages so that the feed mechanism is stopped.

Since, at this time, the planetary gear 96 is squeezed by means of the driving gear 66 in-between the gear 66 and the input gear 86, the same does not separate from the driving gear 66 and achieves smooth transmission of power.

In the present embodiment, when the condition to start printing is established after the auto sheet feeder 80 has been mounted on the printing machine 61 through the positioning means 70, the disengagement mechanism 100 is automatically operated so that the planetary gears 95, 96 of the mesh engagement mechanism 90 come into normal mesh engagement with the driving gear 66. Hence, even if the printing machine 61 is displaced relative to the auto sheet feeder 80, the input gear 86 can be put in normal mesh engagement with the driving gear 66 through the planetary gears 95, 96, so that automatic feeding of the sheet is smoothly performed by the power of the printing machine.

When the auto sheet feeder 80 is detached from the printing machine 61, the disengagement mechanism 100 is automatically operated again so that the planetary gears 95, 96 are pulled back and separated from the driving gear 66. Thus, the mesh engagement and disengagement between the input gear 86 and the driving gear 66 are automatically performed through the disengagement mechanism 100, and thereby, operating efficiency of the apparatus can be enhanced.

Further, since the switching of the clutch between the feed mechanism and the gear mechanism 84 can be performed through the switching operation of the rotating direction of the input gear 86, the need for a clutch switching device or such a special device can be eliminated.

Further, since the auto sheet feeder 80 is driven by the power from the printing machine, there is no need for having an independent driving source, and thereby, the auto sheet feeder 80 can be made simpler in structure and lower in cost.

Further, since the coupling means 89 is incorporated in the auto sheet feeder 80, the printing machine 61 can be of the same structure as before, and thereby, the apparatus can be effectively prevented from becoming complex in structure and large in size.

The arrangement in which the first and second arms 91, 92 are rotated in the directions of the arrowheads G and F by opening up and shutting down the cover 82 was described above, but, instead of such an arrangement with the use of the cover 82, an arm releasing button or the like may be provided on the auto sheet feeder 80, so that the first and second arms 91, 92 may be rotated in the directions indicated by the arrowheads J, K using such a button.

Although the arrangement in which the switching of the clutch is performed by changing the rotating direction of the input gear 86 was described above, if the switching of the clutch need not be performed through the changing operation of the rotating direction of the input gear 86, the input gear 86 may be rotated only in one direction. In such a case, the mesh engagement mechanism 90 may be arranged without using the second arm 92 for reversing the rotation of the input gear 86.

Further, since the arrangement having a pair of arms provided with their respective planetary gears is employed, positive power transmission is ensured by such a planetary gear arrangement regardless of whether the motor is rotated in the normal direction or in the reverse direction.

What is claimed is:

1. Apparatus for sheet feeding for use in a printing machine, said printing machine having a sequential arrangement of a reversible motor, a transmission mechanism, and a rotatable platen provided on its frame, said apparatus for sheet feeding comprising:

an auto sheet feeder detachably mounted on said printing machine comprising a sheet holder holding at least a pile of plural sheets, a sheet feeder roller to be put into contact with the topmost layer of the sheets in the sheet holder, and an input gear coupled with the sheet feeder roller;

an arm having a first end supported at a center of said input gear for rotation around an axis of rotation of said input gear;

a torsion spring connected to said arm to urge said arm to move toward a gear of said transmission mechanism; and a planetary gear attached to a second end of said arm for rotation, constantly held in mesh with said input gear, and disposed to oppose the periphery of said gear of said transmission mechanism.

2. Apparatus for sheet feeding for use in printing machine, said printing machine having a sequential arrangement of a reversible motor, a transmission mechanism, and a rotatable platen provided on its frame, said apparatus for sheet feeding comprising:

an auto sheet feeder detachably mounted on said printing machine comprising a sheet holder holding at least a pile of plural sheets, a sheet feed roller to be put into contact with the topmost layer of the sheets in the sheet holder, and an input gear coupled with the sheet feed roller;

a pair of arms each having a first end supported at a center of said input gear for rotation around an axis of rotation of said input gear;

a torsion spring connected to each of said arms to urge said arms to move inwardly toward each other to a straight line connecting the centers of said input gear and a gear in said transmission mechanism; and a pair of planetary gears each thereof being attached to a respective second end of said arms for rotation, constantly held in mesh with said input gear, and disposed to oppose the periphery of said gear of said transmission mechanism.

3. Apparatus for sheet feeding for use in a printing machine with an auto sheet feeder that is adapted to be detachably mounted on a printing machine and, when the same is mounted on the printing machine, to be driven by power of the printing machine transmitted through an input gear, comprising coupling means made up of:

a mesh engagement mechanism including an arm held by said input gear for rotation around an axis of said input gear, a planetary gear rotatably provided at one end of said arm and in mesh with said input gear, and a torsion spring, when said auto sheet feeder is mounted on said printing machine, for urging said arm in one direction to thereby bring said planetary gear into mesh engagement with a gear on the side of the printing machine; and disengagement mechanism, when said auto sheet feeder is detached from said printing machine, for pulling back said arm against the spring force of said torsion spring.

* * * * *